US007415828B2

(12) United States Patent
Brown

(10) Patent No.: US 7,415,828 B2
(45) Date of Patent: Aug. 26, 2008

(54) FUEL NOZZLE SHEATH RETENTION RING

(75) Inventor: Isabelle Brown, Burlington (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 820 days.

(21) Appl. No.: 10/446,870

(22) Filed: May 29, 2003

(65) Prior Publication Data

US 2004/0237530 A1 Dec. 2, 2004

(51) Int. Cl.
*F02C 7/20* (2006.01)

(52) U.S. Cl. ..... 60/798; 60/740

(58) Field of Classification Search ..... 60/798, 60/734, 740

See application file for complete search history.

(56) References Cited

U.S. PATENT DOCUMENTS 2,780,061 A 2/1957 Clarke et al.
3,999,376 A 12/1976 Jeryan et al.
4,185,462 A * 1/1980 Morse et al. ..... 60/761
4,322,945 A 4/1982 Peterson et al.
4,761,959 A * 8/1988 Romey et al. ..... 60/740
4,798,330 A 1/1989 Mancini et al.
5,269,468 A 12/1993 Adiutori
5,335,490 A * 8/1994 Johnson et al. ..... 60/764
5,579,645 A 12/1996 Prociw et al.
5,598,696 A 2/1997 Stotts
6,497,105 B1 12/2002 Stastny

* cited by examiner

*Primary Examiner*—Charles G. Freay
(74) *Attorney, Agent, or Firm*—Ogilvy Renault LLP

(57) ABSTRACT

A gas turbine fuel nozzle comprises a body and a sheath adapted to surround the body. A snap-on device is provided for releasably retaining the sheath on the body. The snap-on device is displaceable between a first position for allowing the sheath to be fitted over the body and a second position for retaining the sheath in place about the body.

24 Claims, 4 Drawing Sheets

FUEL NOZZLE SHEATH RETENTION RING

BACKGROUND OF THE INVENTION

1. Field of the Invention

The present invention relates to fuel nozzles for gas turbine engines and, more particularly, to a protective sheath assembly for such fuel nozzles.

2. Description of the Prior Art

Fuel nozzles for gas turbine engines are well known in the prior art. Such conventional fuel nozzles are used to supply fuel to a combustion chamber which is provided for igniting the fuel mixture, thereby producing the energy which is used to power the engine. Generally, the combustion chamber includes a plurality of fuel nozzles to thus ensure a proper distribution of the fuel mixture within the combustion chamber.

Conventional fuel nozzles include an inlet fitting, which is coupled to a fuel manifold, and a stem defining a number of fuel passages for directing fuel from the inlet fitting to a tip assembly adapted to atomize the fuel delivered to the combustion chamber. A particular problem with gas turbine fuel nozzles is that the nozzles are located in a hot area of the engine. This heat can cause the fuel passing through the nozzle stem to rise in temperature sufficiently that the fuel can carbonize or coke. Such coking can clog the nozzle and prevent the nozzle from spraying properly. Accordingly, fuel nozzles are typically provided with a protective sheath or heat shield which surrounds the nozzle stem to form an annular air gap thereabout. The sheath and the air gap provide thermal insulation to the fuel nozzle stem in order to prevent the fuel flowing therethrough from coking.

Various methods have been developed to physically attach the protective sheath to the fuel nozzle. For instance, it has been proposed to permanently secure the sheath to the fuel nozzle by brazing or welding the open upper end of the sheath to an enlarged neck provided on the nozzle stem. It has also been proposed to clamp the sheath to the nozzle stem. According to this sheath attachment method, the clamp surrounds the upper end of the sheath to clamp the sheath against the enlarged neck of the nozzle stem. It has also been proposed to secure the sheath to the nozzle stem by means of radial pins extending through the sheath and pressure fitted into the nozzle stem.

The above-described sheath attaching methods are generally of a permanent nature and require the use of tools to install the sheath on the fuel nozzle. It would be highly beneficial to have a non-permanent sheath attaching method and arrangement by which the sheath could be readily installed and removed without requiring any tools.

SUMMARY OF THE INVENTION

It is therefore an aim of the present invention to provide a new gas turbine fuel nozzle heat shield assembly, wherein the heat shield is properly attached to the fuel nozzle yet allowing the heat shield to be easily removed without damaging the fuel nozzle.

It is also an aim of the present invention to provide a new fuel nozzle protective sheath assembly which can be readily installed onto a fuel nozzle without the use of tools.

Therefore, in accordance with the present invention, there is provided a gas turbine fuel nozzle comprising a body, a sheath adapted to surround said body, and a snap-on device for releasably retaining said sheath on said body, said snap-on device being displaceable between a first position for allowing said sheath to be fitted over said body and a second position for retaining said sheath in place about said body.

In accordance with a further general aspect of the present invention, there is provided a sheath assembly for a gas turbine engine fuel nozzle, the sheath assembly comprising a tubular sheath adapted to surround at least a portion of the fuel nozzle, and a retaining device adapted to releasably hold said sheath in place on the fuel nozzle, said retaining device being displaceable between a first position for allowing said sheath to be fitted over said fuel nozzle and a second position for retaining said sheath in position on said fuel nozzle.

In accordance with a still further general aspect of the present invention, there is provided a gas turbine engine fuel nozzle comprising a tubular sheath removably mounted to a fuel nozzle stem by a snap ring retained in grooves formed in the nozzle stem and the tubular sheath.

In accordance with a still further general aspect of the present invention, there is provided a gas turbine engine fuel nozzle comprising a nozzle body, a detachable protective sheath, and a deflectable sheath retainer adapted to releasably engage a catch, said deflectable sheath retainer being disposed on one of said body and said sheath, and said catch being disposed on another one of said body and said sheath.

In accordance with a still further general aspect of the present invention, there is provided a method for removably mounting a sheath to a gas turbine fuel nozzle, the method comprising the steps of: a) providing a snap-on retainer on the gas turbine fuel nozzle, and b) sliding the sheath over a stem portion of said fuel nozzle until the sheath snap into engagement with said snap-on retainer.

In accordance with a further general aspect of the present invention, the snap-on retainer includes a spring-loaded ring and step a) comprises the steps of: machining a peripheral groove in a said stem portion of said fuel nozzle, and placing said spring-loaded ring in said peripheral groove prior to sliding said sheath over said stem portion.

In accordance with a still further aspect of the present invention, the method further comprises the step of: machining a groove in an inner surface of said sheath for receiving said spring-loaded ring.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
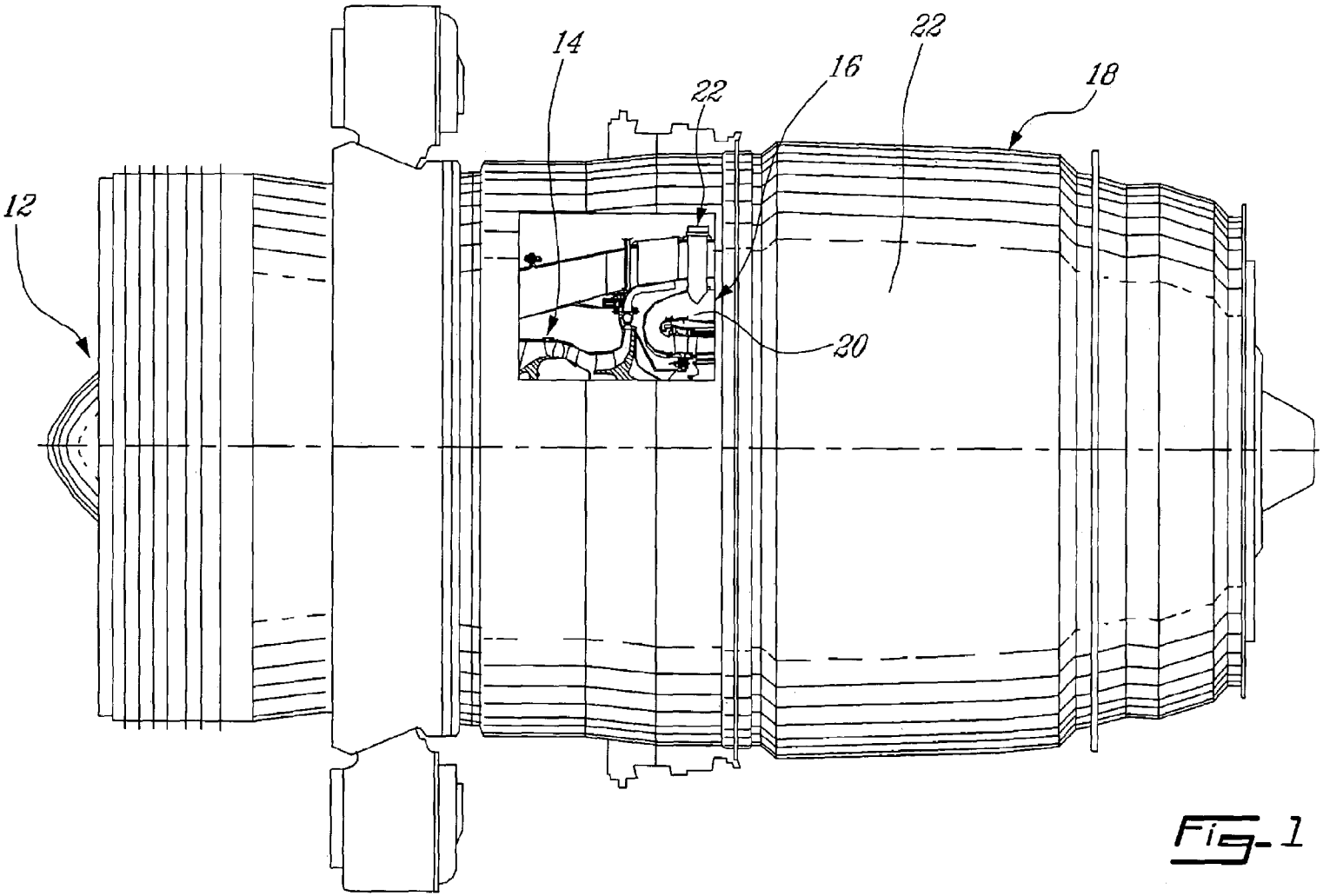
FIG. 1 is a side view, partly broken away, of a gas turbine engine to which an embodiment of the present invention is applied.

FIG. 1 illustrates a gas turbine engine 10 generally comprising in serial flow communication a fan 12 (not provided with all types of engine) through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases. Although a turbofan engine has been shown, it is noted that the present invention could used in other types of gas turbine engine, such as turboprops, turboshafts, Auxiliary power units and industrial gas turbine engines.

The combustor 16 typically comprises a combustion chamber 20 and a plurality of fuel nozzles (only one being shown at 22), which are typically equally spaced about the circumference of the combustion chamber 20 in order to permit a substantially uniform temperature distribution in the combustion chamber 20 to be maintained. In use, the fuel provided by a fuel manifold (not shown) is atomized by the fuel nozzles into the combustion chamber 20 for ignition therein, and the expanding gases caused by the fuel ignition drives the turbine 18 in a manner well known in the art.

Figure 2:
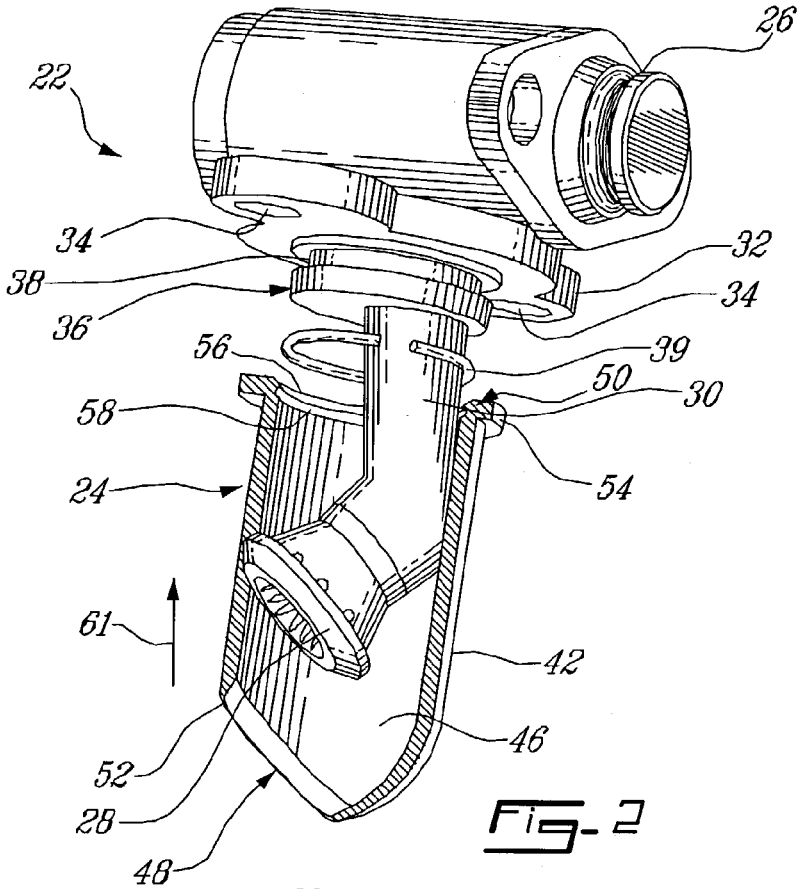
FIG. 2 is an exploded perspective view of a fuel nozzle and heat shield assembly in accordance with a preferred embodiment of the present invention.

As shown in FIG. 2, each fuel nozzle 22 is protected against heat by a heat shield or protective sheath assembly 24. The fuel nozzle 22 is generally of conventional design and comprises an inlet fitting 26 adapted to be connected to an engine manifold (not shown), a tip assembly or atomizing nozzle 28 for spraying or atomizing the fuel into the combustion chamber 20, and a nozzle stem 30 extending between and fluidly interconnecting the inlet fitting 26 and the atomizing nozzle 28. A flange 32 extends laterally outwardly from the upstream end of the stem 30. Holes 34 are defined in the flange 32 to enable the fuel nozzle to be securely mounted to the case of the combustion chamber 20.

Figure 4:
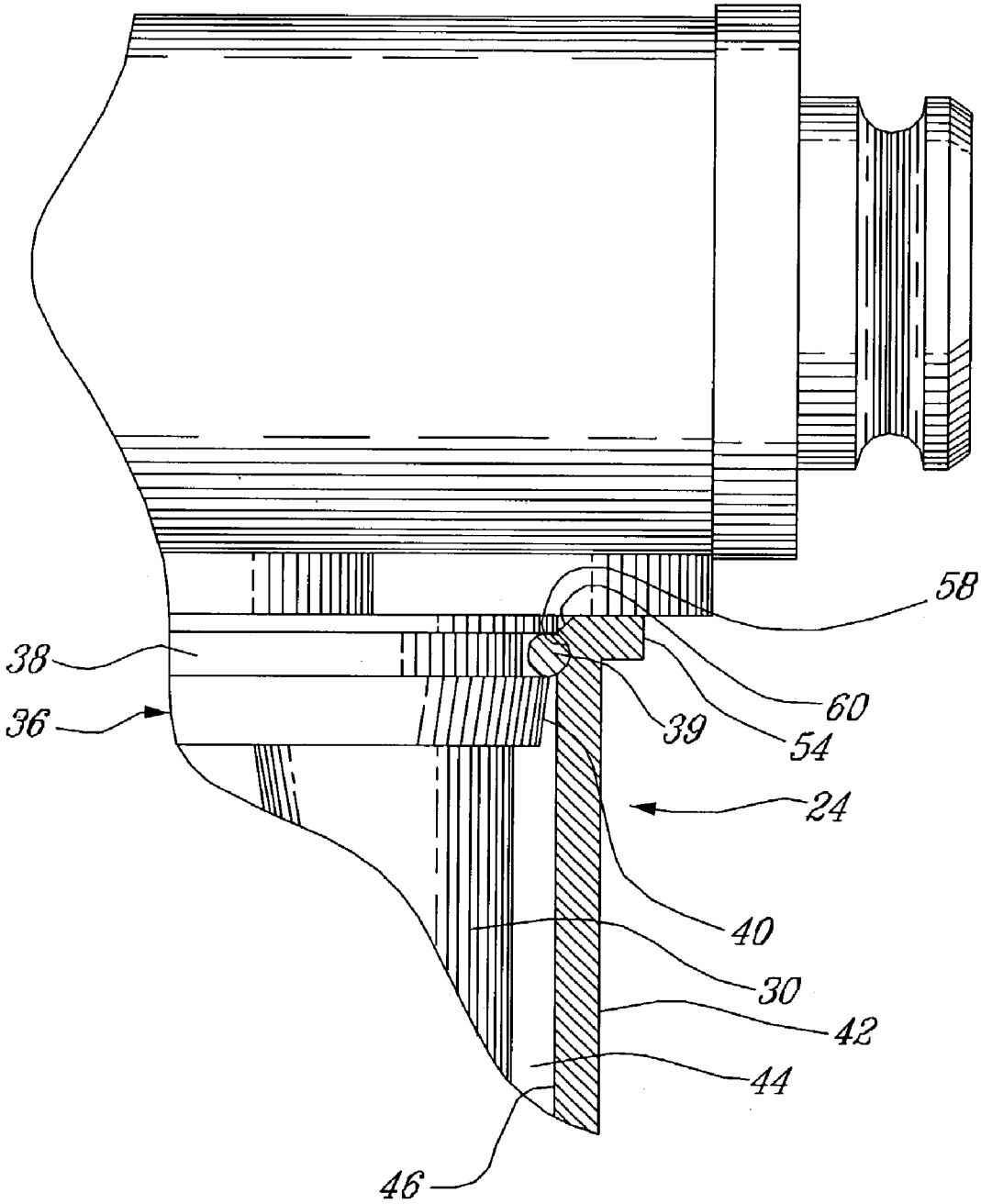
FIG. 4 is an enlarged side view, partly in section, illustrating how the heat shield is retained in place on the fuel nozzle.

The stem 30 has an enlarged neck portion 36 directly underneath the flange 32. A circumferentially extending groove 38 is machined in the outer surface of the neck portion 36 for receiving a snap ring 39 forming part of the protective sheath assembly 24. As best seen in FIG. 4, the portion of the neck 36 below the groove 38 has a frustoconical profile defining a ramp 40 for facilitating the installation of the snap ring 39 in the groove 38 by sliding the ring 39 over the stem until the ring 39 captively falls into the groove 38. The snap ring 39 is made of a springy metallic material and is design to be received with a loose fit in the stem groove 38.

As shown in FIG. 2, the protective sheath assembly 24 further comprises an open ended tubular shield or sheath 42 adapted to be removably mounted to the fuel nozzle 22 so as to define an annular air gap about the stem 30. The sheath 42 and the annular air gap 44 (see FIGS. 3 and 4) provide thermal insulation to the stem 30 in order to prevent the fuel flowing therethrough from coking.

Figure 3:
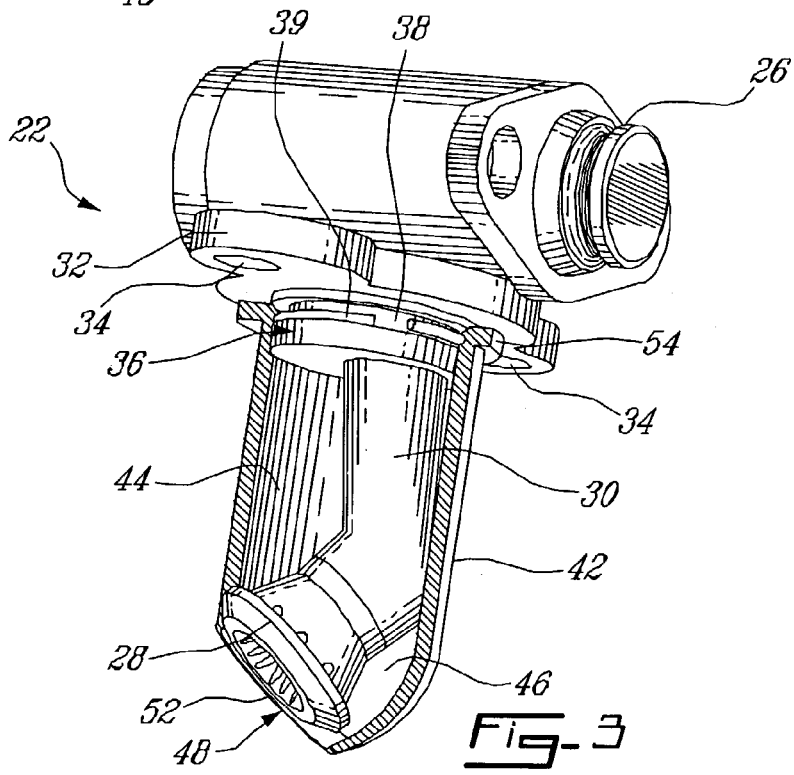
FIG. 3 is a perspective view of the fuel and heat shield assembly once assembled.

The sheath 42 is preferably of unitary construction and is cylindrical in shape. The sheath 42 has an inner circumferential wall 46 extending from a lower end 48 to an upper end 50. As shown in FIG. 3, the lower end 48 is machined to define a round shaped opening 52 for accommodating the angled tip atomizing assembly 28 of the fuel nozzle 22. The upper end 50 has a circumferential shoulder 54 extending about a circular opening 56. A circumferential shallow groove 58 is defined in the inner surface of the sheath 42 at the level of the shoulder 54 for snap engagement with the snap ring 39 in order to releasably axially retain the sheath 42 on the fuel nozzle stem 30. The inner surface 46 of the sheath 42 at the upper end 50 thereof is machined so as to define a chamfer 60 (FIG. 4) for allowing the snap ring 39 to be initially contracted radially inwardly when pushed by the sheath 42 while the same is being slid over the nozzle stem 30 towards its final position.

The sheath 42 is installed on the fuel nozzle 22 by first placing the snap ring 39 into the stem groove 38. This is done by sliding the ring 39 axially along the nozzle stem 30 to the groove 38. The ring 39 is gradually expanded while moving along the ramp 40 before returning back to its rest or unsolicited position upon reaching the groove 38. Once in the groove 38, the ring 39 loosely surrounds the stem 30 so as to provide enough play for the ring 39 to be radially contracted towards the central axis of the nozzle stem 30.

The sheath 42 is then slid onto the nozzle stem 30 (in the direction indicated by arrow 61 in FIG. 1) until the chamfer 60 engages the snap ring 39. As the sheath 42 continues to move along the stem 30, the ring 39 is circumferentially compressed inward (ring gap is closed) in the stem groove 38. When the sheath 42 reaches its final position, the snap ring 39 expands back into the sheath groove 58, retaining the sheath 42 in position for installation of the nozzle assembly on the engine. Note that a guide pin or the like (not shown) can be used to ensure proper alignment of the sheath 42 with the tip assembly 28, as know in the art.

As best seen in FIG. 4, the snap-ring 39 has a round cross-section, which matches the outline of the sheath groove 58. The rounded cross-sectional shape of the snap-ring 39 advantageously provides for easy removal of the sheath 42 by simply pulling it off the assembly. The sheath can be reinstalled back onto the fuel nozzle assembly or replaced by a similar one if need be.

Figure 5:
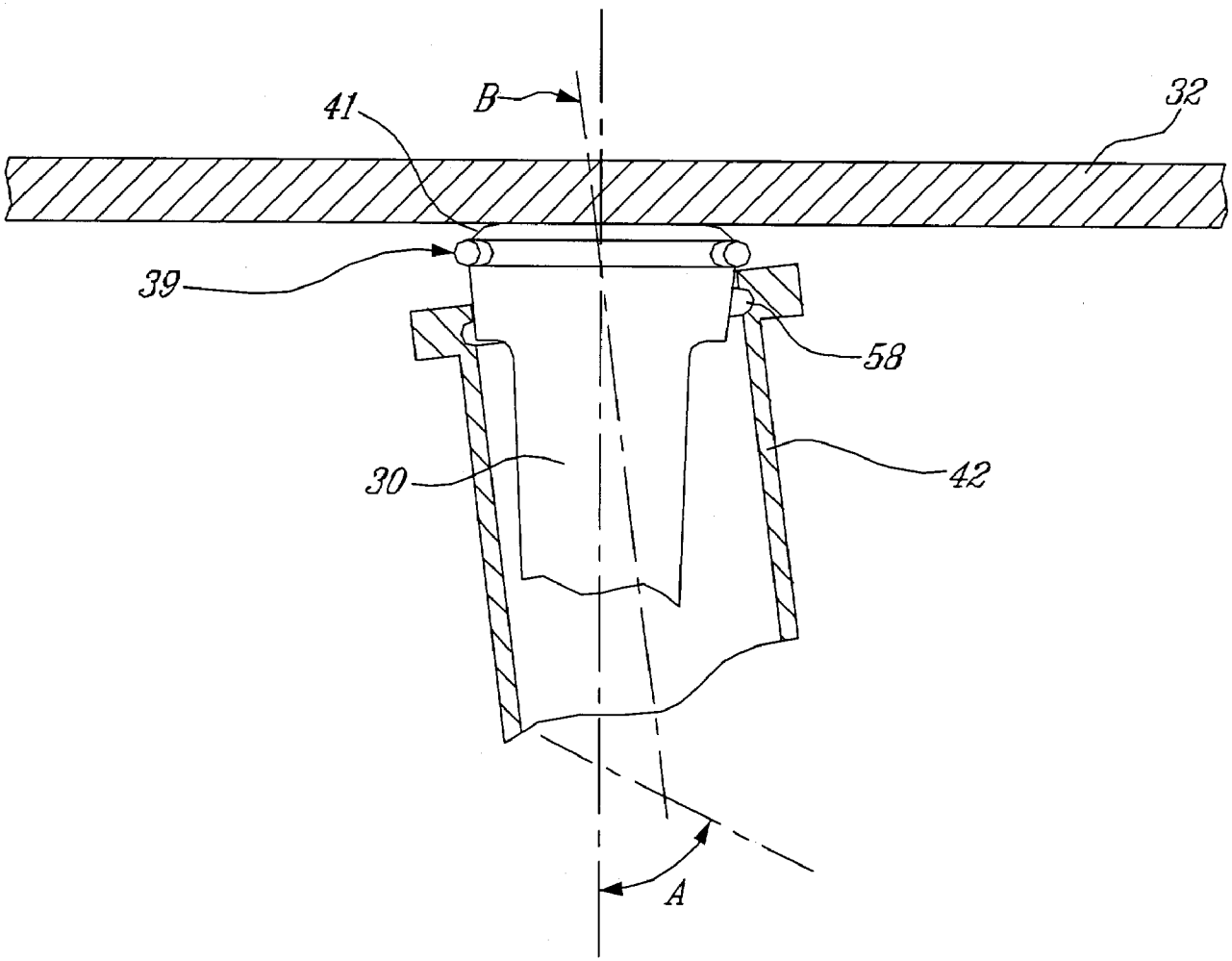
FIG. 5 is an enlarged cross-sectional side view illustrating a nozzle stem having a rounded stem neck in accordance with a further general aspect of the present invention.

As shown in FIG. 5, the rounded cross-sectional shape of the snap-ring 39 introduces the novel concept of a rounded stem neck 41 which allows assembly of one piece sheaths, such as sheath 42, onto gas turbine nozzles having a large nozzle tip angle A. In some nozzle configurations, the nozzle tip axis A is so large that in order to install the one piece sheath 42 onto the nozzle assembly, the sheath 4 has to be slid at an angle B from the nozzle stem axis. The rounded neck 41 allows assembly of greater combination of angles A and B.

The above-described non-permanent sheath attachment method provides for a tool-free installation/removal of the sheath 42, which constitutes another major advantage over know techniques.

The utilisation of a snap-ring, which is retained captive between the sheath 42 and the nozzle stem 30, for removably holding the sheath 42 on the fuel nozzle 22 is also advantageous in that it provides a very compact sheath retaining arrangement.

However, it is understood that the present invention is not limited to the utilization of a snap-ring and that other types of deflectable or spring-loaded sheath engaging member or retainer could be used for providing releasable attachment of the sheath on the fuel nozzle assembly. Also, various types of catches could be provided on the protective sheath or on the fuel nozzle assembly for releasable engagement with a corresponding sheath retainer.

The present invention is also advantageous in that misassembly of the sheath 42 can be easily detected by the sheath 42 not being properly retained/attached to the fuel nozzle 22 upon removal of the nozzle 22 from the combustion case 20. The sheath 42 can be easily removed for overhaul and maintenance purposes. Furthermore, the sheath 42 and the snap ring 39 are simple and inexpensive to manufacture and assemble.

The invention claimed is:

1. A gas turbine fuel nozzle assembly comprising a fuel nozzle body having a nozzle tip adpated to deliver atomized fuel to a combustor, a sheath adapted to surround said fuel nozzle body, and a snap-on device provided generally circumferentially between the nozzle body and the sheath for releasably retaining said sheath on said body, said snap-on device being radially contractible to a first position for allowing said sheath to be fitted over said nozzle body, the snap-on device adapted to radially spring back to a second position to retainingly engage with the sheath relative to the nozzle body.

2. A gas turbine engine fuel nozzle as defined in claim 1, wherein said snap-on device is displaced to said first position thereof by said sheath while the sheath is being axially slid over the nozzle stem to a final position, and wherein said snap-on device is automatically displaced to said second position thereof when said sheath reaches said final position thereof.

3. A gas turbine engine fuel nozzle as defined in claim 2, wherein said sheath has an inner surface adapted to push said snap-on device to said first position thereof while said sheath is being displaced to said final position thereof, and wherein a catch is defined in said inner surface for allowing said snap-on device to expand into said catch when said sheath reaches said final position.

4. A gas turbine engine fuel nozzle as defined in claim 1, wherein said snap-on device includes a spring-loaded sheath engaging member.

5. A gas turbine engine fuel nozzle as defined in claim 4, wherein said spring-loaded sheath engaging member is mounted to said body for engagement in a corresponding catch defined in said sheath.

6. A gas turbine engine fuel nozzle as defined in claim 5, wherein said spring-loaded sheath engaging member includes a snap ring captively received in a peripheral groove defined in said body of said gas turbine engine fuel nozzle.

7. A gas turbine engine fuel nozzle as defined in claim 6, wherein said body includes a nozzle stem, and wherein said groove is defined in said nozzle stem.

8. A gas turbine engine fuel nozzle as defined in claim 7, wherein said stem is provided with an attachment flange at one end portion thereof, and wherein said groove is located below said flange.

9. A gas turbine engine fuel nozzle as defined in claim 6, wherein said catch includes a circumferentially extending groove defined in the inner surface of said sheath.

10. A gas turbine engine fuel nozzle as defined in claim 3, wherein said snap-on device includes a spring-loaded ring received in a peripheral groove defined in said body.

11. A gas turbine engine fuel nozzle as defined in claim 2, wherein said snap-on device includes a spring-loaded ring received in a pair of grooves, said grooves being respectively defined in an outer surface of said body and an inner surface of said sheath.

12. A gas turbine engine fuel nozzle as defined in claim 7, wherein a ramp is provided on said nozzle stem.

13. A gas turbine engine fuel nozzle as defined in claim 11, wherein said spring-loaded ring has a substantially rounded cross-section.

14. A sheath assembly for a gas turbine engine fuel nozzle, the sheath assembly comprising a tubular sheath adapted to surround at least a portion of the fuel nozzle, and a retaining device adapted to releasably hold said sheath in place on the fuel nozzle, said retaining device including a snap-on retaining member compressible between a first position for allowing said sheath to be fitted over said fuel nozzle and a second position for retaining said sheath in position on said fuel nozzle.

15. A sheath assembly as defined in claim 14, wherein said retaining device is located within said tabular sheath.

16. A sheath assembly as defined in claim 14, wherein said retaining device is pre-mounted to said body for engaging said sheath in a snap-fit manner.

17. A sheath assembly as defined in claim 16, wherein said retaining device includes a spring-loaded sheath engaging member, said spring-loaded sheath engaging member being expandable in snap engagement in a catch defined in an inner surface of said tubular sheath.

18. A sheath assembly as defined in claim 17, wherein said spring-loaded sheath engaging member includes a snap ring, and wherein said catch includes a circumferentially extending groove.

19. A gas turbine engine fuel nozzle comprising a tubular sheath removably mounted to a fuel nozzle stem by a snap ring retained in grooves formed in the nozzle stem and the tubular sheath.

20. A gas turbine engine nozzle as defined in claim 19, wherein said grooves include a first groove defined in an inner surface of said sheath and a second groove defined in an outer surface of said fuel nozzle stem.

21. A gas turbine engine fuel nozzle as defined in claim 19, wherein said snap ring has a substantially round cross-section.

22. A gas turbine engine fuel nozzle comprising a nozzle body, a detachable protective sheath, and a deflectable sheath retainer adapted to releasably engage a catch, said deflectable sheath retainer being disposed on one of said body and said sheath, and said catch being disposed on another one of said body and said sheath.

23. A gas turbine engine fuel nozzle as defined in claim 22, wherein said deflectable sheath includes a spring-loaded sheath engaging member, said spring-loaded sheath engaging member being displaceable between a retracted position wherein said sheath is permitted to be fitted over said body, and an expanded position wherein said sheath engaging member is engaged with said catch to prevent removal of said sheath from said body.

24. A gas turbine engine fuel nozzle as defined in claim 23, wherein said spring-loaded sheath engaging member includes a snap ring mounted in a peripheral groove defined said body, said snap ring having a round cross-section to facilitate removal of said sheath from said body.

* * * * *